United States Patent [19]

Anderson

[11] Patent Number: 4,910,902

[45] Date of Patent: Mar. 27, 1990

[54] SIGN HOLDING STAKE

[75] Inventor: Joe Anderson, McDonough, Ga.

[73] Assignee: Terry O. Greer, Hampton, Ga. ; a part interest

[21] Appl. No.: 245,692

[22] Filed: Sep. 19, 1988

[51] Int. Cl.[4] ..... G09F 15/00

[52] U.S. Cl. ..... 40/607; 248/156; 248/530; 248/545

[58] Field of Search ..... 248/156, 545, 530, 533, 248/507, 508, 160; 40/606, 611, 607

[56] References Cited

U.S. PATENT DOCUMENTS

| | | | |
|---|---|---|---|
| 1,389,587 | 9/1921 | Hilborn | 40/606 |
| 1,854,145 | 4/1932 | Wright | 40/606 |
| 2,607,398 | 8/1952 | Andrews | 248/156 |
| 3,119,588 | 1/1964 | Keats | 40/606 X |
| 3,255,986 | 6/1966 | Eadie | 248/156 X |
| 3,358,952 | 12/1967 | Burns | 248/530 X |
| 3,922,805 | 12/1975 | Krug | 40/606 X |
| 4,249,715 | 2/1981 | Repp | 40/607 X |
| 4,309,836 | 1/1982 | Knapp | 40/606 X |

FOREIGN PATENT DOCUMENTS

| | | | |
|---|---|---|---|
| 29365 | 3/1977 | Japan | 248/156 |

*Primary Examiner*—David L. Talbott
*Attorney, Agent, or Firm*—James B. Middleton

[57] ABSTRACT

A stake is drivable into the ground for holding a sign post. The stake has a clamp at its upper end so that the stake can be driven into the ground, then a conventional sign post can be clamped for support. The stake includes a flange, of rods, used to stabilize the stake and prevent rotation. The clamp may also include holes to received small flag poles as an additional attraction to the sign.

8 Claims, 1 Drawing Sheet

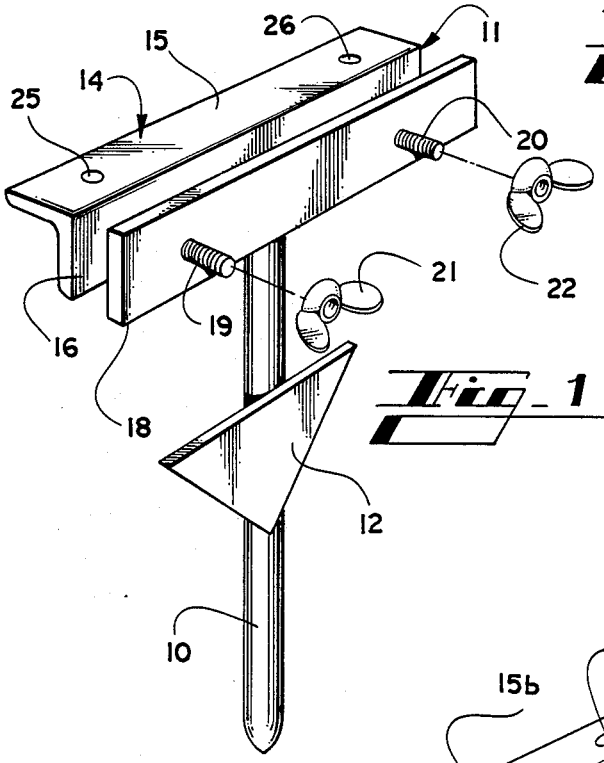
Fig_1
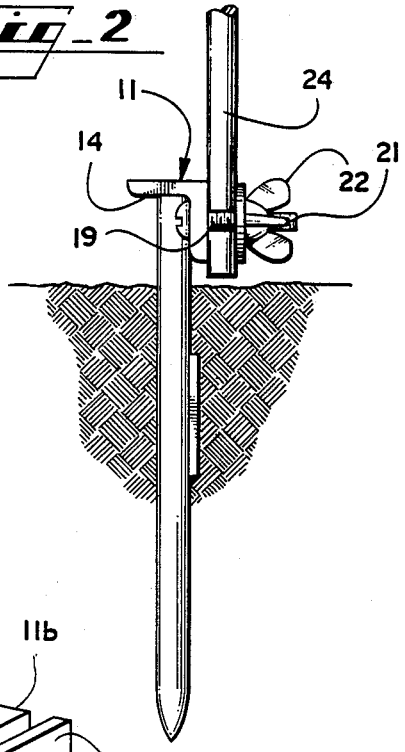
Fig_2
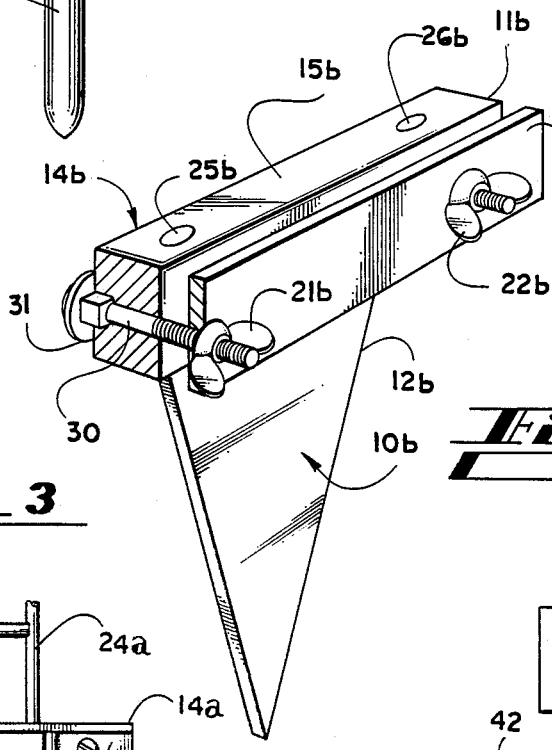
Fig_4
Fig_3
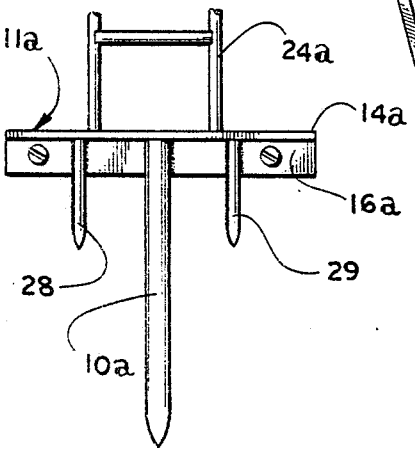
Fig_5
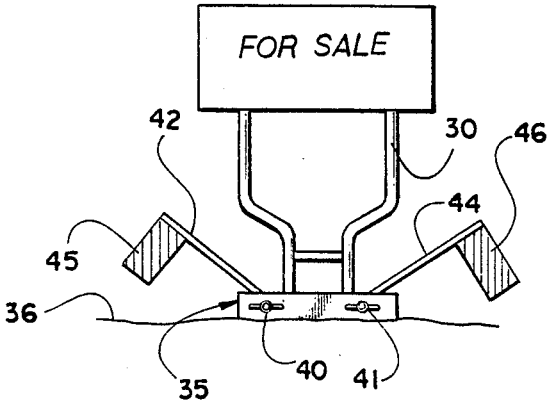

SIGN HOLDING STAKE

INFORMATION DISCLOSURE STATEMENT

It is very common to display a sign on a piece of property or the like by attaching the sign to a post and urging the lower end of the post into the ground to support the post and the sign. Such an arrangement is very commonly used for signs advertising real estate for lease or sale; further, a given real estate agency usually has one style of post for use with all property listed with that agency. While there is a general form of sign post used for real estate signs, there are several variations in the specific structure of the sign post. All of the sign posts of the prior art have the difficulty that the lower end of the post is simply to be urged into the ground using a person's foot. If the ground is very dry and hard it is virtually impossible to urge the post into the ground, and no means is provided for driving the post into the ground.

The prior art has provided some sign posts intended to solve the above mentioned problems, but the prior art includes such apparatus as the patent to Litwiller U.S. Pat. No. 4,483,506 which includes a sleeve for receiving a post, so that the post must truly fit the sleeve, and little variation is possible. Another form of prior art device is shown in the patent to Wortham U.S. Pat. No. 4,402,166. This device is unique to the particular sign post and is not adaptable to other forms of posts or signs. The prior art therefore does not provide a drivable stake that is adapted to grasp and support a wide variety of signs and sign posts.

SUMMARY OF THE INVENTION

This invention relates generally to sign posts, and is more particularly concerned with a drivable stake for supporting a sign post.

The present invention includes a stake carrying clamp means at its upper end. The stake and clamp means are so arranged that the stake can be driven into the ground using a conventional hammer or virtually any other heavy object. After the stake has been well driven into the ground, the clamp means can be released to receive a conventional sign post. The clamp means will grip the lower end of the sign post to support the post without requiring that the sign post be urged into the ground.

In the preferred embodiment of the invention, stabilizing means is provided on the stake, and additional attracting means is optionally provided.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing one form of the stake made in accordance with the present invention;

FIG. 2 is a side elevational view of the stake shown in FIG. 1, the stake in FIG. 2 being shown driven into the ground and supporting a sign post;

FIG. 3 is a rear elevational view, on a reduced scale, showing a slightly modified form of stake;

FIG. 4 is a perspective view, partially in cross-section, showing another modified form of stake made in accordance with the present invention; and, FIG. 5 is a front elevational view, on a reduced scale, showing the stake of the present invention supporting a sign and additional attracting means.

DETAILED DESCRIPTION OF THE EMBODIMENTS

Referring now more particularly to the drawings, and to those embodiments of the invention here presented by way of illustration, the stake shown in FIG. 1 includes a pointed rod 10 carrying a clamp member generally designated at 11 at the upper end of the rod 10. Generally centrally of the rod 10 there is a stabilizing means designated at 12. Thus, the rod 10 can be driven into the ground, and the stabilizing means 12 will prevent rotation of the rod 10, and will of course render extraction more difficult.

Looking more specifically at the clamp means 11, it will be noted that there is a fixed clamp member 14 comprising a piece of angle iron having the flange 15 disposed horizontally and the flange 16 disposed vertically. Extending parallel to the vertical flange 16, there is a clamp bar 18.

With attention to FIG. 2 also, it will be noted that there are two screws 19 and 20 fixed to the flange 16 and extending therethrough. The clamp bar 18, then, defines holes for receiving the screws 19 and 20. Nuts 21 and 22 are threadedly receivable on the screws 19 and 20.

Thus, as is shown in FIGS. 1 and 2, the rod 10 can be driven in to the ground by hitting on the horizontal flange 15 of the angle iron 14. When the rod 10 is sufficiently driven into the ground, the nuts 21 and 22 can be loosened and the bar 18 slipped sufficiently far away from the flange 16 that the sign post 24 can be received between the flange 16 and the clamp bar 18. The nuts 21 and 22 can then be tightened to secure the sign post 24. It will also be noticed in FIG. 1 that the horizontal flange 15 defines angled openings 25 and 26 for receiving additional attracting means. This will be discussed in more detail hereinafter.

FIG. 3 of the drawings shows a stake very similar to the stake illustrated in FIGS. 1 and 2, the only difference being the form of stabilizing means. The embodiment of the invention shown in FIG. 3 includes the rod **10*a* and angle iron 14*a*. Rather than utilizing the triangular member 12 as a stabilizer, the embodiment of the stake shown in FIG. 3 includes a pair of spikes 28 and 29 welded or otherwise fixed to the vertical flange 16*a* of the angle iron 14*a*. The spikes 28 and 29 extend substantially parallel to the rod 10*a* and are preferably pointed at their lower ends. It will therefore be understood that the stake shown in FIG. 3 can be driven into the ground as previously described, and one will continue to drive the stake into the ground until the spikes 28 and 29 engage the ground sufficiently to prevent rotation of the stake. A sign post 24*a* is shown engaged in the clamp member 11*a***.

Another form of the invention is shown in FIG. 4 of the drawings. The embodiment illustrated in FIG. 4 is cross-hatched to indicated metal, but it will be equally understood by those skilled in the art that this embodiment of the invention is particularly well adapted for construction of plastics or virtually any other material having sufficient strength to hold the intended sign. The clamp member in FIG. 4 is generally designated at **11*b*, and the rod is generally referred to at 10*b*. In this embodiment of the invention, the rod 10*b* is formed integrally with the stabilizing means 12*b* in that the rod 10*b*** is somewhat triangular so that, when the rod 10b is driven into the ground, the width at 12b is sufficient that the stake will not rotate.

The clamp member 11b is formed of a rectangular stationary member 14b and a clamp bar 18b similar to the clamp bar 18 in FIG. 1. The stationary member 14b defines holes such as the hole 30 for receiving a carriage bolt 31. As before, the threaded end of the bolt 31 extends sufficiently beyond the stationary member 14b to receive the bar 18b and nuts 21b and 22b.

The upper surface, designated at 15b, includes diagonal holes 25b and 26b for receiving additional attracting means.

It will therefore be seen that the embodiment of the invention illustrated in FIG. 4 includes the rectangular member 14b having the rod member 10b fixed thereto. One can drive the stake into the ground by hitting the horizontal surface 15b until the stake 10b is driven into the ground sufficiently that the stabilizing means, or wide portion, 12b engages the ground and prevents rotation of the stake. The nuts 21b and 22b can be loosened sufficiently that a sign post can be received between the clamp bar 18b and the stationary member 14b, the nuts 21b and 22b then being tightened sufficiently to hold the sign. Finally, attention is directed to FIG. 5 of the drawings which shows a stake made in accordance with the present invention driven into the ground and supporting a sign. In FIG. 5, the stake of the present invention is generally designated at 35, and the ground level is designated at 36. A sign post 38 is received within the clamp member 39 of the stake 35, and it will be noted that nuts 40 and 41 secure the sign post 38 in the clamp member 39. It will also be seen in FIG. 5 of the drawings that additional attracting means are included.

Both FIGS. 1 and 4 include diagonally oriented holes for receipt of small sticks or the like. As is illustrated in FIG. 5, these holes may receive sticks 42 and 44 which carry flags 45 and 46. As illustrated in FIG. 5, the flags 45 and 46 are simply colored flags; however, those skilled in the art will understand that various words or notices can be printed on the flags. Also, while a rectangular flag is here shown, pennants and the like might be used to attract attention if desired.

From the above description, it will be understood that the present invention provides an extremely convenient means for supporting a sign on a piece of property. The stake of the present invention can be forcefully driven into very hard ground, using a large hammer or any heavy object that is sufficient for driving a stake. With the stake received in the ground, a stabilizing means will prevent rotation or inadvertent removal of the stake from the ground; and, clamp means carried by the stake will receive a conventional sign or sign post. As a result, regardless of the type of sign or sign post utilized by a real estate company or others who wish to erect a sign, the stake of the present invention can be driven into the ground, and the clamp means of the present invention will receive the particular sign.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In combination, a sign for placement on real estate and a stake for receiving and supporting said sign, said sign including a generally vertical sign post having an upper end and a lower end, said lower end including a pair of parallel rods, a sign board carried at said upper end of said sign post, said lower end extending below said sign board and said pair of parallel rods being adapted for normally being received in the ground for supporting sign post, said stake including a horizontally extending clamp member, said clamp member comprising a stationary member and a movable member coextensive with said stationary member, and a vertically extending rod fixed to said stationary member of said clamp member, said stationary member being adapted to receive the striking force for driving said vertically extending rod into the ground, at least one stud extending through said stationary member of said clamp member and through said movable member of said clamp member for allowing said movable member to move towards and away from said stationary member, and at least one nut receivable on said stud for selectively fixing said movable member with respect to said stationary member, both of said parallel rods of said lower end of said sign post being received between said stationary member and said movable member of said clamp member and fixed by tightening said nut on said stud, the arrangement being such that said stake is driven into the ground, and said sign post is subsequently attached thereto by clamping said lower end of said sign post in said clamp member.

2. The combination claimed in claim 1, and further including stabilizing means for preventing rotation of said vertically extending rod.

3. The combination claimed in claim 2, said stationary member including a horizontal flange, and a vertical flange contiguous with said horizontal flange.

4. The combination claimed in claim 3, said stabilizing means comprising a flange fixed to said vertically extending rod.

5. The combination claimed in claim 3, said stabilizing means comprising at least one spike fixed to said vertical flange and extending parallel to said vertically extending rod.

6. The combination claimed in claim 5, and further including means for mounting attracting means, said means for mounting attracting means comprising holes defined in said stationary member of said clamp means, said holes being adapted for receiving sticks carrying said attracting means.

7. The combination claimed in claim 1, said stationary member including a rectangular member, said vertically extending rod being integral with said rectangular member and extending downwardly therefrom, said at least one stud including a bolt received through a hole in said rectangular member.

8. The combination claimed in claim 7, and further including means for mounting attracting means, said means for mounting attracting means comprising holes defined in said stationary member of said clamp means, said holes being adapted for receiving sticks carrying said attracting means.

* * * * *